US006446920B1

(12) United States Patent
Wells et al.

(10) Patent No.: US 6,446,920 B1
(45) Date of Patent: Sep. 10, 2002

(54) ERGONOMIC HAND REST FOR GAMING MACHINE

(76) Inventors: John C. Wells, 213 Yellow Sky St., Las Vegas, NV (US) 89145; Jason Robertson, 213 Yellow Sky St., Las Vegas, NV (US) 89145

( * ) Notice: Subject to any disclaimer, the term of this patent is extended or adjusted under 35 U.S.C. 154(b) by 0 days.

(21) Appl. No.: 09/559,491

(22) Filed: Apr. 27, 2000

(51) Int. Cl.[7] ..... B68G 5/00

(52) U.S. Cl. ..... 248/118; 248/118.1; 248/918; 248/118.3; 248/118.5

(58) Field of Search ..... 248/118, 118.3, 248/118.5, 281.1, 214, 918, 227.4; 463/13, 16, 47

(56) References Cited

U.S. PATENT DOCUMENTS 4,481,556 A * 11/1984 Berke et al. ..... 361/222
4,482,063 A * 11/1984 Berke et al. ..... 211/69.1
4,482,064 A * 11/1984 Berke et al. ..... 211/69.1
5,465,931 A * 11/1995 MacDonald ..... 248/118.3
5,660,360 A * 8/1997 Yang ..... 248/118
6,059,238 A * 5/2000 Reynolds et al. ..... 248/118
6,161,805 A * 12/2000 Wells ..... 248/118
6,179,261 B1 * 1/2001 Lin ..... 248/274.1
6,244,547 B1 * 6/2001 Tonizzo et al. ..... 248/118.3

* cited by examiner

*Primary Examiner*—Leslie A. Braun
*Assistant Examiner*—Steven Marsh
(74) *Attorney, Agent, or Firm*—Weiss & Moy, P.C.; Harry M. Weiss; Jeffrey Weiss

(57) ABSTRACT

An ergonomic hand rest that may be either mounted on an existing gaming machine or included as a standard feature in a new machine includes an interface member adapted to be connected to the gaming machine. A support member has a base arranged to be connected to the interface member and a support plate extending from the base. A wrist cushion has a recess in which the support plate extends when the wrist cushion, the interface member and the support member are assembled together. The interface member includes means for coupling the interface member to the gaming machine.

8 Claims, 2 Drawing Sheets

ERGONOMIC HAND REST FOR GAMING MACHINE

RELATED APPLICATIONS

This patent application is a continuation-in-part of the patent application filed in the name of John. C. Wells (a co-inventor of the subject patent application) which is entitled ERGONOMIC HAND REST FOR GAMING MACHINE, Ser. No. 09/301,818, filed Apr. 29, 1999. This patent application is also filed concurrently with the patent application that was also filed by the inventors of the subject patent application entitled BAR TOP ERGONOMIC DEVICE which was filed on Apr. 27, 2000.

BACKGROUND OF THE INVENTION

This invention relates to an ergonomic hand rest for a gaming machine such as a slot machine or a video poker machine and method therefor.

Existing video gaming machines typically have a video display and a keyboard. No provision is made for an ergonomic hand rest for users of such machines.

SUMMARY OF THE INVENTION

The present invention provides an ergonomic hand rest that may be either mounted on existing gaming machines or included as a standard feature in new machines.

An ergonomic support according to the present invention for the wrists of a person using a gaming device comprises an interface member adapted to be connected to the gaming device, a support member having a base arranged to be connected to the interface member and a support plate extending from the base and a wrist cushion arranged to be connected to the support member. The wrist cushion has a recess therein and the support plate is arranged to extend into the recess when the wrist cushion, the interface member and the support member are assembled together.

The interface member preferably includes holes adapted for demountably coupling the interface member to the gaming machine.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 2:
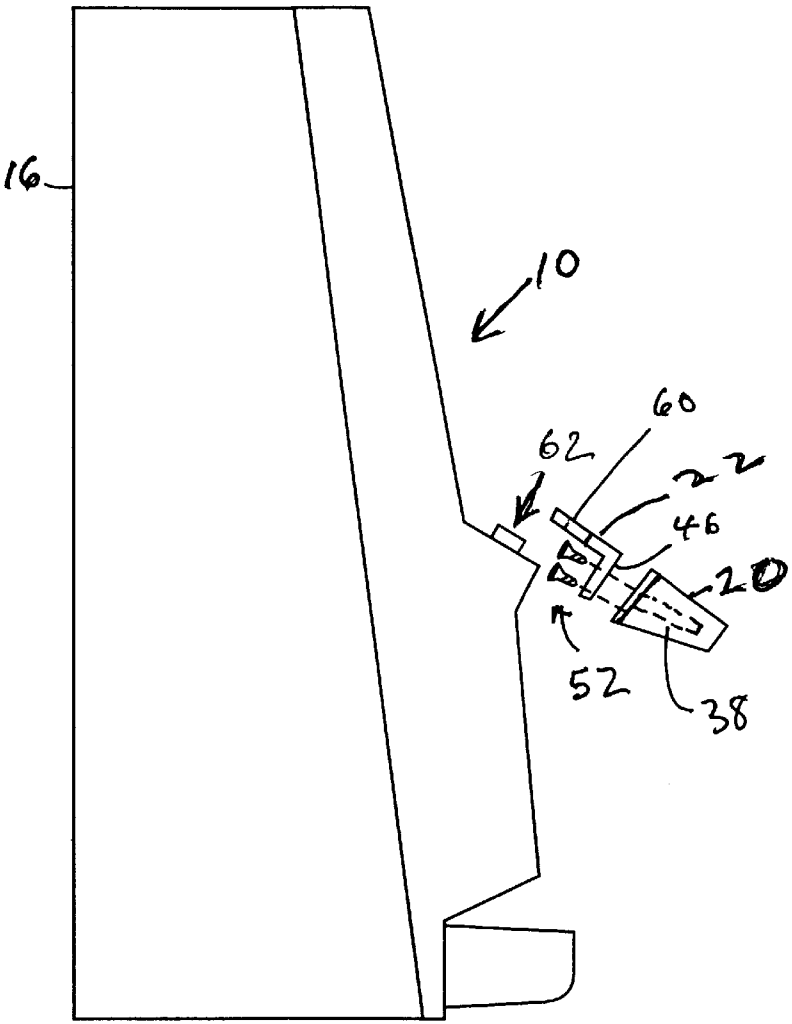
FIG. 2 is a side elevation view of the apparatus of FIG. 1.
Figure 1:
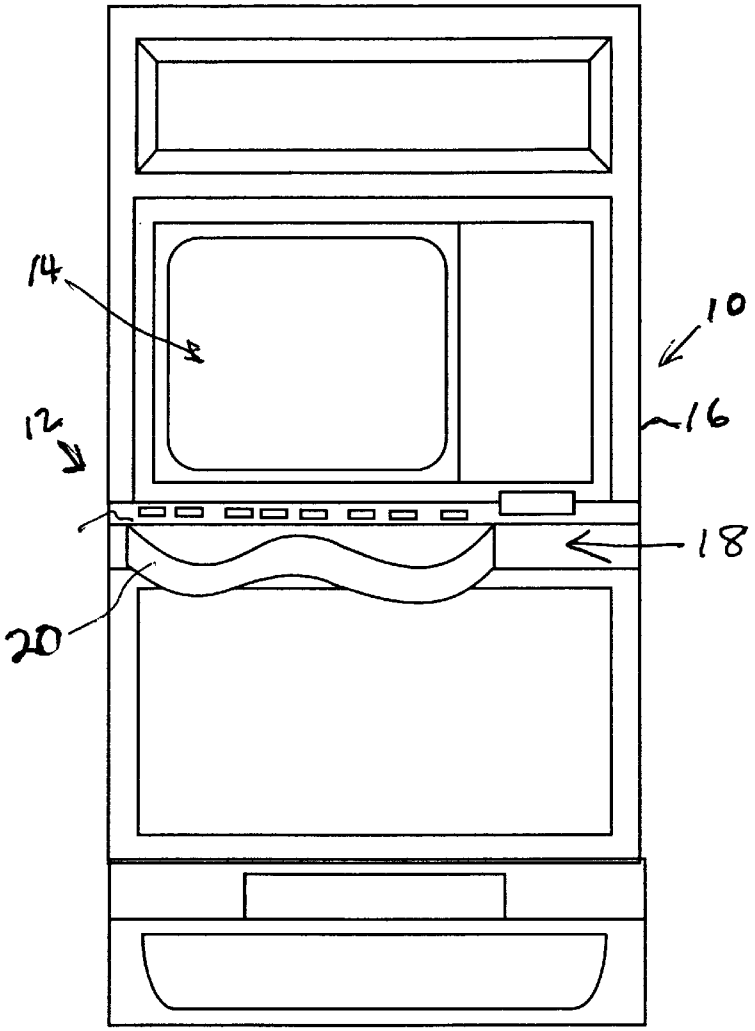
FIG. 1 is a front elevation view of an ergonomic hand rest according to the present invention mounted to a gaming machine.

FIGS. 1 and 2 show a video gaming machine 10 such as a video poker machine. The video gaming machine 10 typically has a keyboard 12 and a display 14 mounted in a housing 16.

An ergonomic device 18 according to the present invention is mounted to a front portion of the housing 16 to support the wrists of a person using the keyboard who can use the ergonomic device 18. The ergonomic device 18 is arranged such that a person can use the video gaming machine 10 with increased convenience and comfort.

Figure 3:
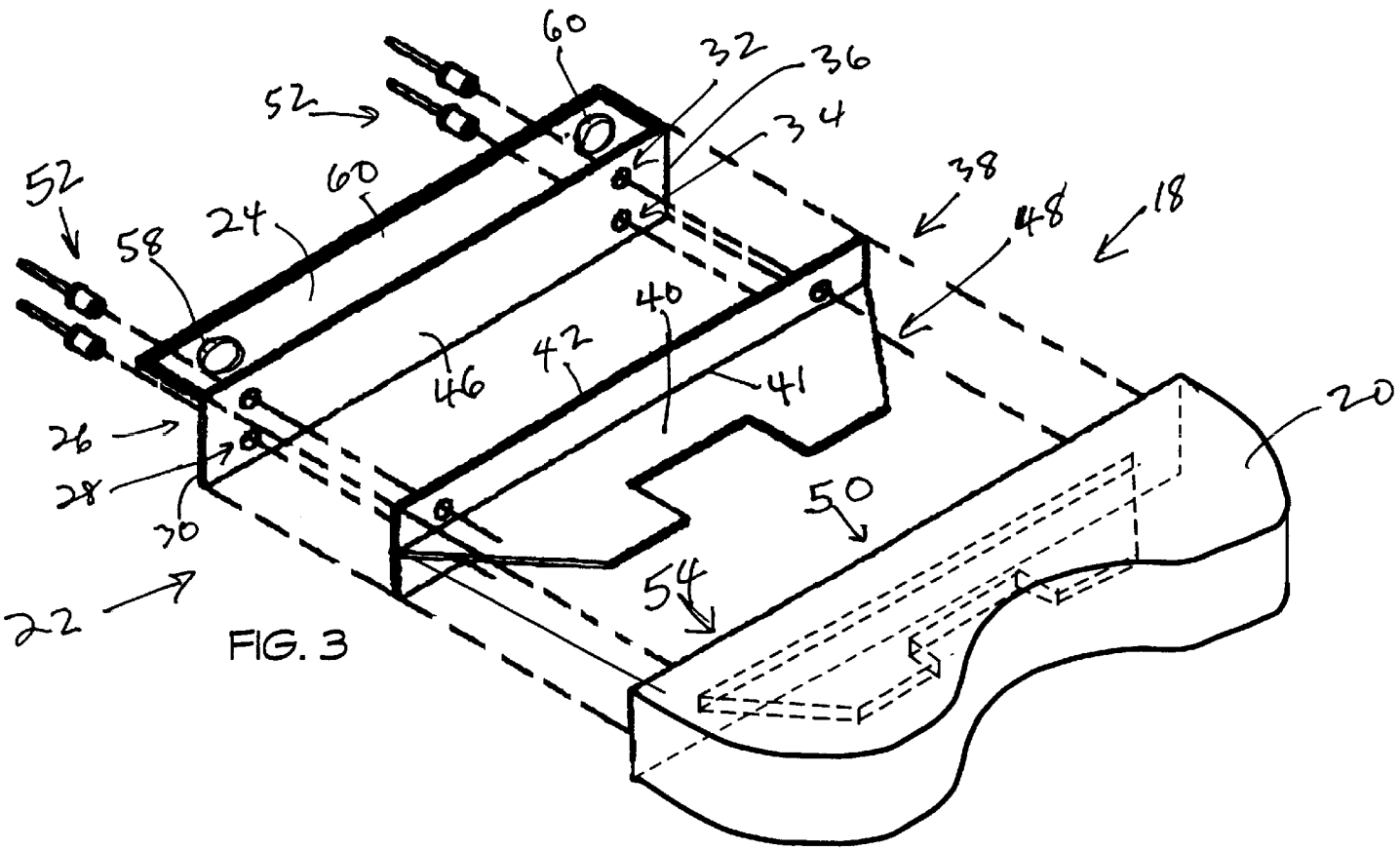
FIG. 3 is an exploded perspective view of the ergonomic hand rest of FIGS. 1 and 2.
Figure 5:
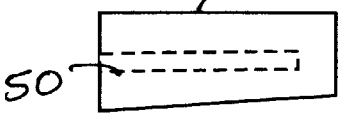
FIG. 5 is a left side elevational view of the wrist cushion shown in FIGS. 1 and 3 which depicts the recess therein in broken lines.
Figure 4:
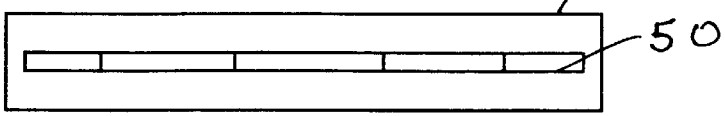
FIG. 4 is a front side elevational view of the wrist cushion of FIG. 3 showing a recess therein.

Referring to FIG. 3, the ergonomic device 18 includes a wrist cushion 20 and a frame 22. The wrist cushion 20 is connected to the frame 22, which is connected to the housing 16.

The frame 22 includes an interface member 24 which may be formed to have an "L" shaped cross section and a length of about 14 in. The interface member 24 has a pair of holes 26 and 28 near an end 30 and a pair of holes 32 and 34 at the other end 36.

The frame 22 further includes a support member 38 having a "T" shaped cross section when viewed from either end. When viewed from above, the support member 38 is seen as a flat plate 40 having a flat plate 42 that forms the top of the "T" connected to an edge 41. When the ergonomic device 18 is assembled, the top 42 of the T-shaped support member 38 is adjacent to a leg 46 of the L-shaped interface member 24. The leg 48 of the T-shaped support member 38 is formed as a thin plate that extends into a corresponding recess 50 in the wrist cushion 20. Rivets 52 (see FIGS. 2 and 3) extend through the holes 26, 28, 32, and 34 into the a side 54 of the wrist cushion 20.

The ergonomic device 18 may be attached to the gaming machine in various ways. The embodiment illustrated and described herein has a pair of holes 56 and 58 in the leg 60 of the interface member 24 that may be used to mount the ergonomic device 18 to the gaming machine 10. Such gaming machines typically have two or more buttons 62 that extend out from the keyboard. The holes 56 and 58 are arranged to align with the buttons 62 (see FIG. 2). When the interface member 24 is placed adjacent to the housing 16 with the buttons 62 passing through the holes 56 and 58, the ergonomic device 18 will simply hang from the buttons 62.

The ergonomic device 18 may also be attached to the gaming machine 10 using an adhesive, magnetism, rivets or threaded fasteners.

The structures and methods disclosed herein illustrate the principles of the present invention The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. An ergonomic support for the wrists of a person using a gaming device, comprising in combination:

a video gaming device;

an T-shaped interface member connected to the gaming device;

a T-shaped support member having a base connected to the interface member and a support plate extending from the base;

a wrist cushion connected to the T-shaped support member, the wrist cushion having a recess therein, the support plate extends into the recess when the wrist cushion, the interface member and the T-shaped support member are assembled together.

2. The apparatus of claim 1 wherein the L-shaped interface member includes means adapted for demountably coupling the L-shaped interface member to the gaming machine.

3. The apparatus of claim 1 wherein the L-shaped interface member is formed generally as an elongate member that includes a pair of legs, one leg being arranged to abut the base of the T-shaped support member and the other leg connected to the gaming machine.

4. The apparatus of claim 1 wherein the video gaming machine is a video poker machine.

5. A method of providing an ergonomic support for the wrists of a person using a video gaming device comprising the steps of:

providing a gaming device;

providing an interface member adapted to be connected to the video gaming device;

providing a T-shaped support member having a base arranged to be connected to the L-shaped interface member and a support plate extending from the base;

providing a wrist cushion arranged to be connected to the T-shaped support member, the wrist cushion having a recess therein, the support plate being arranged to extend into the recess when the wrist cushion, the interface member and the T-shaped support member are assembled together.

6. The method of claim 5 wherein the L-shaped interface member includes means adapted for demountably coupling the L-shaped interface member to the video gaming machine.

7. The method of claim 5 wherein the L-shaped interface member is formed generally as an elongate member that includes a pair of legs, one leg being arranged to abut the base of the T-shaped support member and the other leg connected to the video gaining machine.

8. The method of claim 5 wherein the video gaming machine is a video poker machine.

* * * * *